US008726559B1

(12) United States Patent
Mueller

(10) Patent No.: US 8,726,559 B1
(45) Date of Patent: May 20, 2014

(54) UNIVERSAL BARREL NUT FOR FIREARM

(71) Applicant: Stephen Mark Mueller, Appleton, WI (US)

(72) Inventor: Stephen Mark Mueller, Appleton, WI (US)

( * ) Notice: Subject to any disclaimer, the term of this patent is extended or adjusted under 35 U.S.C. 154(b) by 0 days.

(21) Appl. No.: 13/750,588

(22) Filed: Jan. 25, 2013

(51) Int. Cl.
*F41A 21/48* (2006.01)

(52) U.S. Cl.
USPC ..... 42/75.02

(58) Field of Classification Search
CPC ..... F41A 21/48; F41A 21/481; F41A 21/482; F41A 21/485
USPC ..... 42/75.01, 75.02
See application file for complete search history.

(56) References Cited

U.S. PATENT DOCUMENTS

| | | | | |
|---|---|---|---|---|
| 5,020,260 | A * | 6/1991 | Houghton | 42/75.02 |
| 6,752,061 | B2 * | 6/2004 | Knorich et al. | 89/14.05 |
| 7,036,259 | B2 * | 5/2006 | Beretta | 42/75.02 |
| 7,313,883 | B2 * | 1/2008 | Leitner-Wise | 42/75.02 |
| 7,464,496 | B1 * | 12/2008 | Davies et al. | 42/75.02 |
| 8,607,490 | B1 * | 12/2013 | Zinsner | 42/71.01 |
| 2004/0049964 | A1 * | 3/2004 | Vais | 42/75.02 |
| 2007/0017139 | A1 * | 1/2007 | Larue | 42/75.1 |
| 2007/0199435 | A1 * | 8/2007 | Hochstrate et al. | 89/191.02 |
| 2010/0281742 | A1 * | 11/2010 | Barrett | 42/75.02 |
| 2011/0061281 | A1 * | 3/2011 | Kapusta et al. | 42/71.01 |
| 2011/0247254 | A1 * | 10/2011 | Barnes | 42/71.01 |
| 2012/0017483 | A1 * | 1/2012 | Vuksanovich | 42/75.02 |

* cited by examiner

*Primary Examiner* — Bret Hayes
(74) *Attorney, Agent, or Firm* — Barnes & Thornburg LLP

(57) ABSTRACT

A barrel nut for a firearm. A cylindrical shell is provided with internal threads extending from one end of the shell and opposite slots extending axially from the opposite end of the shell. A cylindrical core has external threads on one end, with the external threads being shaped to engage the internal threads of the shell. When the core is installed in the shell, it is secured at a desired axial location by at least one fastener secured in a bore of the shell and engaging one of a series of circumferential indentations in the core.

12 Claims, 9 Drawing Sheets

10
12
14
38
38
38

24
12
28
26
14
20
16
44
42
38
44
44
44

UNIVERSAL BARREL NUT FOR FIREARM

BACKGROUND OF THE INVENTION

This invention relates to firearms, and in particular to a universal barrel nut for a firearm, for securing a rail thereon.

In modern firearms, modularity is provided by interchangeable elements, such as the quad rail. The rail is mounted tightly against the receiver, on the barrel. The accessory rail must be appropriately held in place for proper function of the firearm.

SUMMARY OF THE INVENTION

The invention is directed to a barrel nut for properly mounting an accessory rail on a firearm. The barrel nut comprises a cylindrical shell having internal threads extending from one end into one section of the shell. Opposite slots are formed in an opposite end of the shell, extending axially from the opposite end of the shell through a second section of the shell. A cylindrical core has external threads on one end, with the external threads being shaped to matingly engage the internal threads of the shell. An arrangement is provided for securing the cylindrical core at an axial location within the cylindrical shell.

In accordance with the preferred form of the invention, the barrel nut has opposite axial grooves in the shell, each extending from one of the slots to the first end of the shell. The axial grooves are for passage of gas.

A system is provided for orienting the shell on the firearm. The system includes a series of equally-spaced circumferential notches formed in the first end of the shell. The notches extend for 360°.

The arrangement for securing the cylindrical core within the shell comprises at least one fastener secured in and extending through the shell into engagement with a receptor in the core. The receptor comprises a plurality of indentations spaced circumferentially in the core. In one form of the invention, the indentations are spherical. In another form of the invention, the indentations are oblong. In the preferred form of the invention, four fasteners are provided at 90° intervals, each engaging one of the indentations in the core. The fasteners preferably are set screws.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
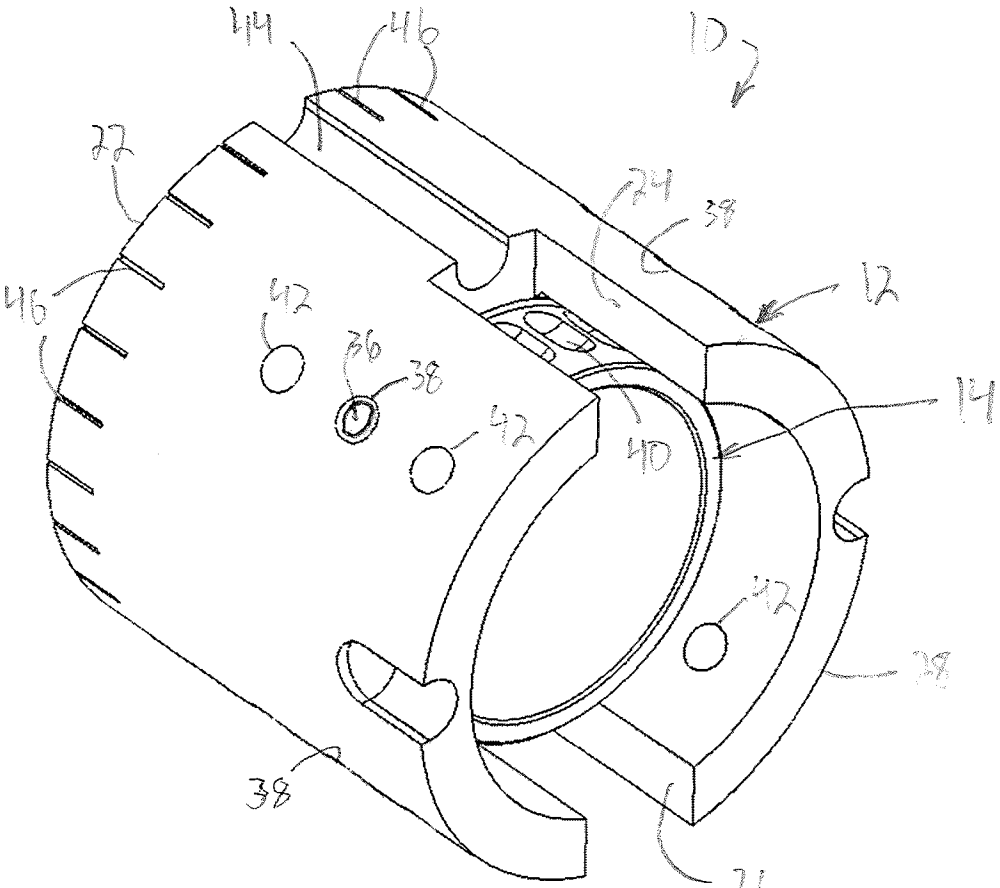
FIG. 1 is an isometric view of a universal barrel nut according to the invention.
Figure 2:
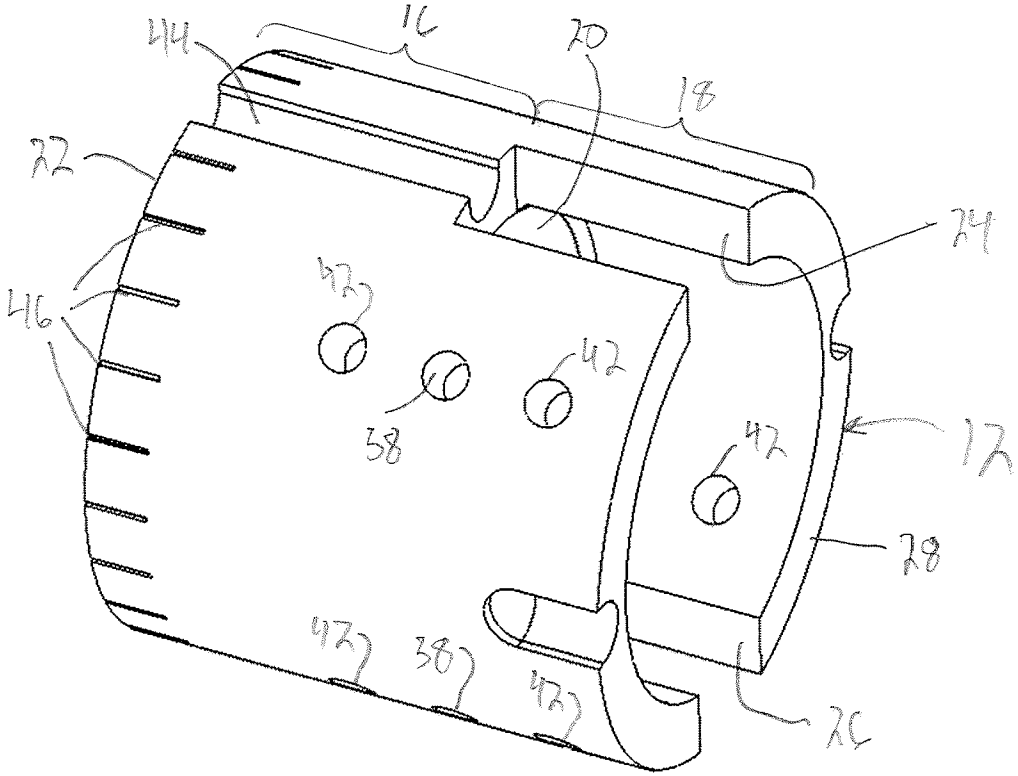
FIG. 2 is an isometric view of the shell of the barrel nut, with the core removed.
Figure 3:
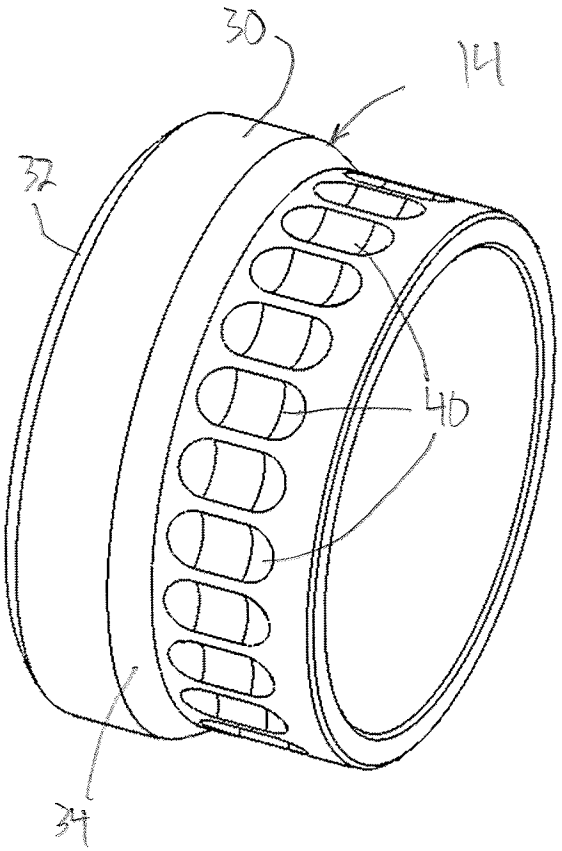
FIG. 3 is an isometric view of the core for the barrel nut.

One form of a universal barrel nut according to the invention is shown at 10 in FIGS. 1-3. The barrel nut 10 comprises a shell 12 which accommodates a core 14.

For the purposes of description, the barrel nut 10 is designated with two sections, a first section 16 and a second section 18. While the sections 16 and 18 are shown with each occupying approximately one half of the barrel nut 10, obviously the sections 16 and 18 can be of varying sizes relative to one another, depending on the formation of the barrel nut 10. The cylindrical shell 12 has internal threads 20 extending from a first end 22 of the shell into the section 16. The shell 12 also includes opposite slots 24 and 26 extending axially from a second end 28 of the shell 12 for the second section 18.

The core 14 includes external threads 30 at one end, with the external threads being shaped to matingly engage the internal threads 20. Camfers 32 and 34 are preferably provided on opposite sides of the threads 30 for ease of use of the core 14, but are not essential.

An arrangement is provided for securing the cylindrical core 14 at an axial location within the cylindrical shell 12. To that end, a fastener 36 is secured in a bore 38 and extends through the shell 12 into engagement with the core 14. The core 14 is provided with a plurality of indentations 40 extending circumferentially about the core 40. Preferably, the indentations are spaced equally about the core 40, and, as best shown in FIG. 3, are oblong in order to readily accommodate a fastener 36. In the preferred form of the invention, the bores 38 are formed in the shell 12 at 90° intervals, thus there being four of the bores 38, each of which has a fastener 36 installed therein.

Figure 9:
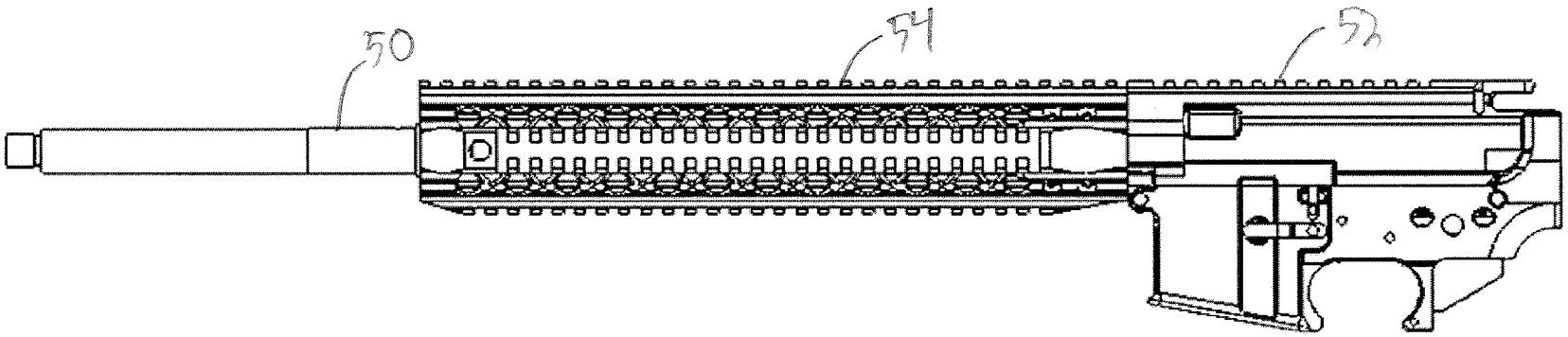
FIG. 9 is a view similar to FIG. 6, with the accessory rail mounted on the barrel nut adjacent the receiver.

As also shown in the drawing figures, the shell 12 includes additional bores 42 on opposite sides of each of the bores 38. The bores 42 are used for mounting of a rail (FIG. 9) on the barrel nut 10. The shell 12, core 14 and fasteners 36 preferably are metal, and all of the bores 38 and 42 are threaded in a conventional fashion.

The shell 12 also includes opposite axial grooves 44 (only one shown in the drawing figures), the axially grooves 44 extending in the shell 12 from one of the slot 24 and 26 to the first end 22, as shown. The grooves 44 are provided for passage of gas, in a conventional fashion.

The barrel nut 10 also includes a system for orienting the shell 12 on a firearm. This system includes a series of equally-spaced circumferential notches 46 in the first end 22, as shown in FIGS. 1 and 2. While the notches 46 are shown as actual indentations in the shell 12, the notches 46 can also be appropriate coloring or other visual indications formed on the shell 12 at the first end 22.

Figure 4:
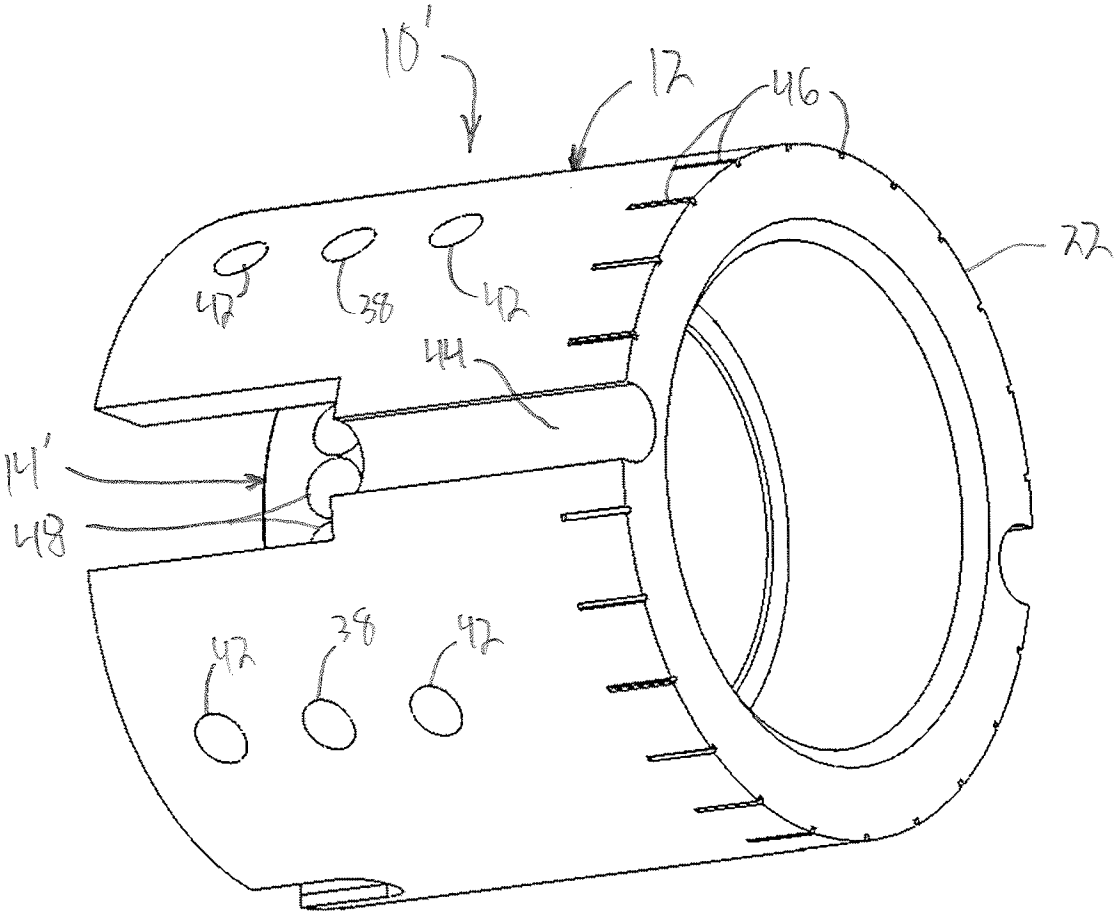
FIG. 4 is an isometric view of a second form of the invention.
Figure 5:
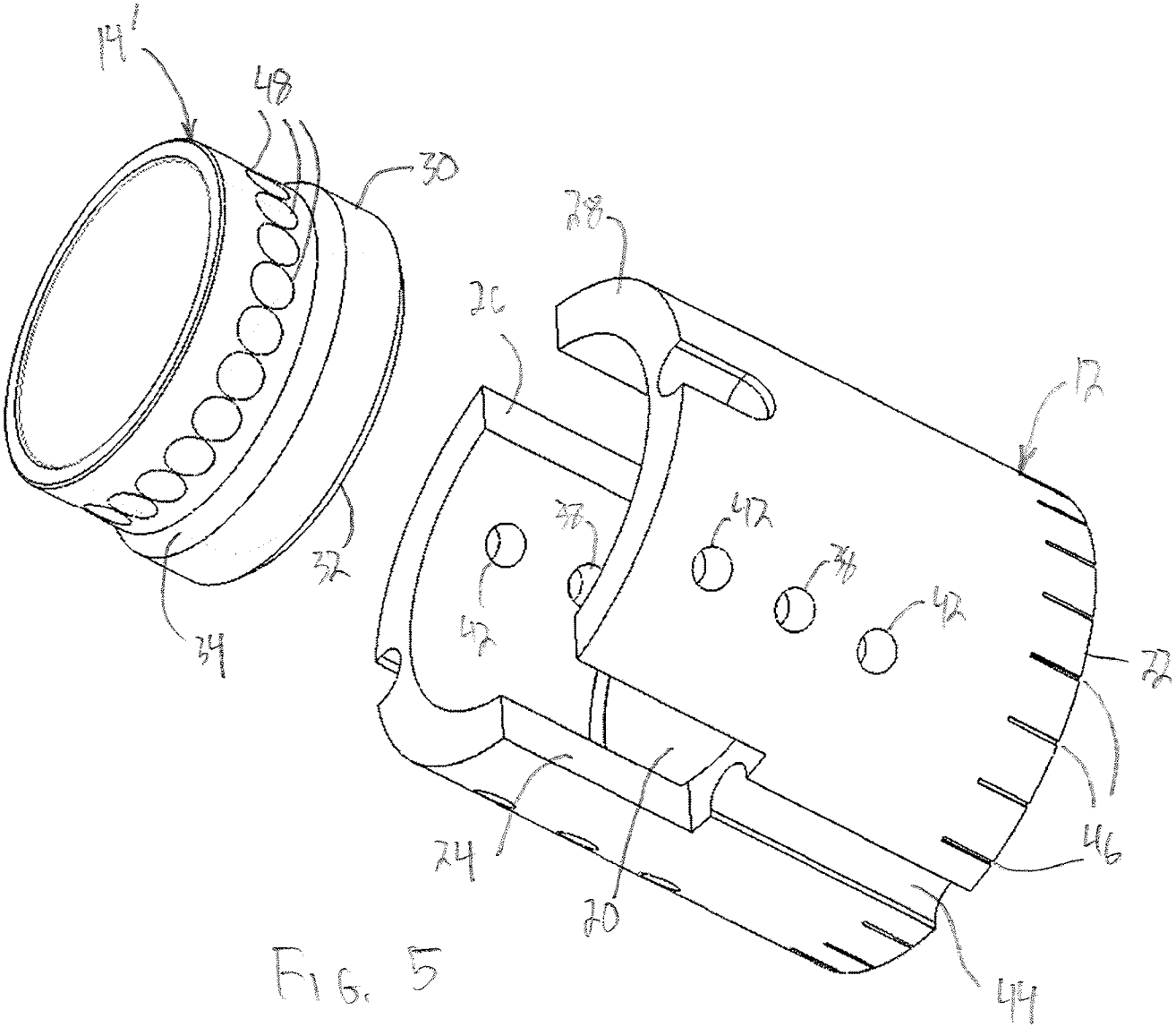
FIG. 5 is an assembly view of the second form of the invention shown in FIG. 4.

A second form of the invention is shown in FIGS. 4 and 5. The barrel nut 10' shown in these figures is essentially identical to that of FIGS. 1-3, and therefore identical elements bare the same reference numerals as those of FIGS. 1-3. In this form of the invention, however, the core 14', otherwise identical to the core 14, includes indentations 48 which are spherical, rather than oblong, as the indentations 40. Otherwise, the elements of FIGS. 4 and 5 are identical to those of FIGS. 1-3.

Figure 6:
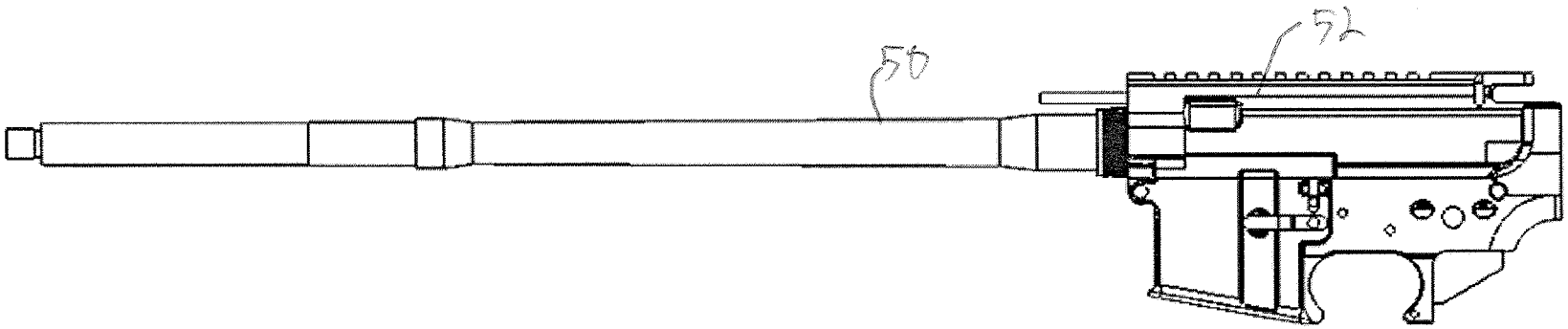
FIG. 6 is an elevational view of the receiver and barrel of a firearm, ready for mounting of the barrel nut of the invention.
Figure 7:
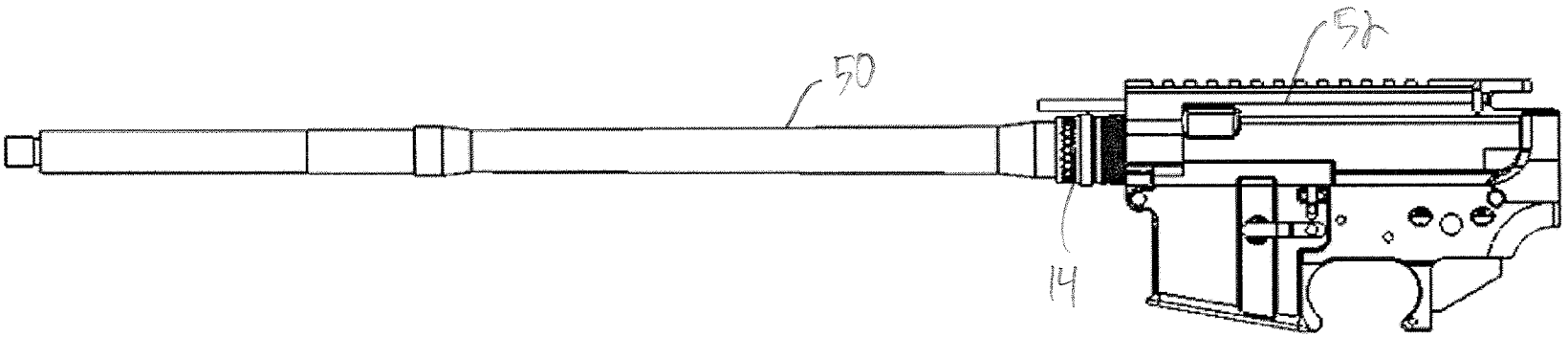
FIG. 7 is a view similar to FIG. 6, with the core in place.
Figure 8:
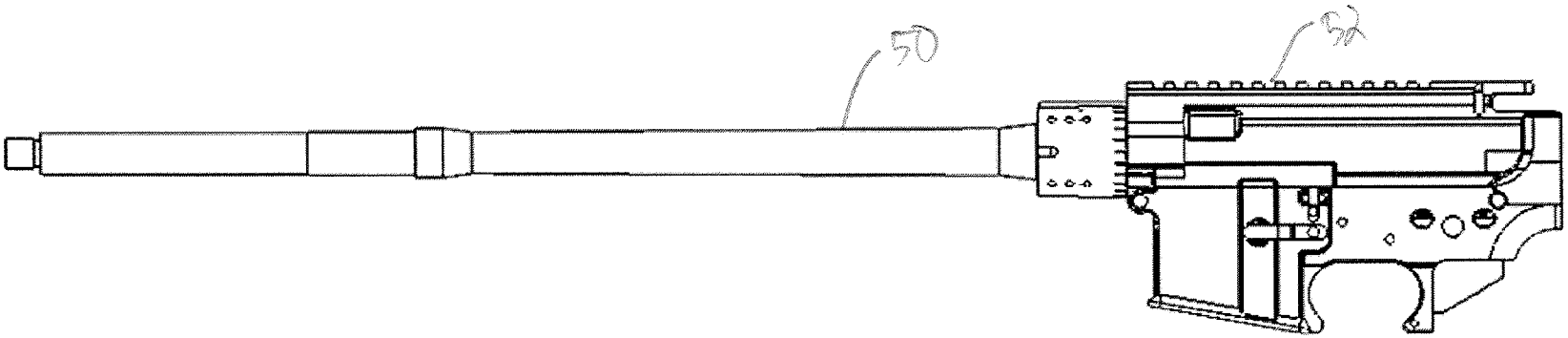
FIG. 8 is a view similar to FIG. 6, with the barrel nut fully in place.

FIGS. 6-9 illustrate mounting of an accessory rail on the barrel of a firearm. FIG. 6 illustrates a barrel 50 extending from a receiver 52. In FIG. 7, the core 14 or 14' is shown in place. In FIG. 8, the barrel nut is fully in place, with the shell 12 on the core 14. Finally, in FIG. 9, an accessory rail 54 is mounted on the barrel nut 10 immediately adjacent the receiver 52. The features of the accessory rail 54 form no part of the present invention, and the accessory rail 54 is secured to the barrel nut 10 by means of appropriate fasteners, such as set screws engaging each of the bores 42.

Various changes can be made to the invention without departing from the spirit of the invention without departing from the spirit thereof or scope of the following claims.

The invention claimed is:

1. A barrel nut for a firearm, comprising a. a cylindrical shell having internal threads extending from a first end into a first section of said shell, b. opposite slots extending axially from an opposite end of said shell for a second section of said shell, c. a cylindrical core having external threads on one end, said external threads being shaped to matingly engage said internal threads, and d. an arrangement for securing said cylindrical core at an axial location within said cylindrical shell.

2. The barrel nut according to claim 1, including opposite axial grooves in said shell each extending from a said slot to said first end.

3. The barrel nut according to claim 1, including a system for orienting said shell on the firearm.

4. The barrel nut according to claim 3, in which said system includes a series of equally-spaced circumferential notches in said first end.

5. The barrel nut according to claim 1, in which said arrangement comprises at least one fastener secured in and extending through said shell into engagement with a receptor in said core.

6. The barrel nut according to claim 5, in which said receptor comprises a plurality of indentations spaced circumferentially in said core.

7. The barrel nut according to claim 6, in which said fastener comprises a set screw, four of said set screws being spaced from one another at 90° intervals.

8. The barrel nut according to claim 6, in which said indentations are spherical.

9. The barrel nut according to claim 6, in which said indentations are oblong.

10. The barrel nut according to claim 1, in which said arrangement comprises i. opposite bores in said shell straddling each slot, ii. a plurality of indentations spaced circumferentially in said core, and iii. a fastener secured in each bore and engaging one of aid indentations.

11. The barrel nut according to claim 10, in which said fastener comprises a set screw, four of said set screws being spaced from one another at 90° intervals.

12. The barrel nut according to claim 10, in which said indentations are spherical.

* * * * *